US005519474A

United States Patent [19]

Arcaro et al.

[11] Patent Number: 5,519,474

[45] Date of Patent: May 21, 1996

[54] PNEUMATIC DELIVERY SYSTEM FOR LIQUID TONER HARD COPY APPARATUS

[75] Inventors: David J. Arcaro, Boise; David L. Smith, Meridian, both of Id.

[73] Assignee: Hewlett Packard Company, Palo Alto, Calif.

[21] Appl. No.: 247,938

[22] Filed: May 24, 1994

[51] Int. Cl.[6] ..... G03G 15/10

[52] U.S. Cl. ..... 355/256; 118/659; 347/24; 355/326 R

[58] Field of Search ..... 355/245, 256, 355/326 R, 327; 118/659, 660; 346/157, 160; 347/20, 24, 35, 112, 126, 140, 149

[56] References Cited

U.S. PATENT DOCUMENTS

| | | | |
|---|---|---|---|
| 3,693,661 | 9/1972 | Aurenge et al. | 137/625.18 |
| 4,987,429 | 1/1991 | Finley et al. | 346/157 |
| 5,003,352 | 3/1991 | Duchesne et al. | 355/256 |
| 5,117,263 | 5/1992 | Adam et al. | 355/256 |
| 5,231,455 | 7/1993 | Day | 355/256 |
| 5,255,058 | 10/1993 | Pinhas et al. | 355/256 |

OTHER PUBLICATIONS

Terrence Lynch, "Do–It–Yourself Dialysis", Design News, Jun. 7, 1993, pp. 60–63.

*Primary Examiner*—Sandra L. Brase

[57] ABSTRACT

A pneumatically powered toner delivery system for a hard copy machine is disclosed which is particularly adaptable to color printing and plotting in which liquid toner is used to produce electrophotographic images. A diaphragm pump is connected by a controllable rotary valve (or a manifold) to each toner reservoir of the system. Pneumatic pressure is selectively applied to the cartridges. The cartridges are connected to respective developer subsystems where toner of a particular color under pneumatic pressure from a reservoir is delivered to a developer subsystem for transfer to a photoconductor bearing a latent image.

16 Claims, 3 Drawing Sheets

PNEUMATIC DELIVERY SYSTEM FOR LIQUID TONER HARD COPY APPARATUS

RELATED APPLICATION

This application is related to U.S. Ser. No. 08/218,614 for a "Developer Actuation System for Hard Copy Production" by Paul Jeran et al. (assigned to the common assignee of the present invention), filed on this same date and incorporated herein by reference in its entirety.

BACKGROUND OF THE INVENTION

1. Field of the Invention

The present invention relates generally to electrophotography and, more particularly, to a pneumatically powered, toner delivery system particularly suited to a multicolor electrophotographic apparatus using liquid toners.

2. Description of the Related Art

Electrophotography employs the formation of an electrostatic latent image to create a hard copy reproduction. In its basic aspects, a substantially uniform charge is applied to a photoconductive insulating surface area of a photoconductor. The charged surface area is exposed to a pattern of light. A latent image of the pattern formed on the surface by charge dispersion is then developed by application of electroscopic toner to the photoconductive material. The developed image is transferred to a hard copy medium and fused to the medium. The photoconductive material insulating surface is then cleaned and reused for the next image. This basic construct is used in the state of the art in variety of products such as computer printers and plotters, copiers, facsimile machines, and the like.

In the field of hard copy reproduction such as with a laser printer using liquid electrophotography techniques to provide full color printing and plotting, yellow, magenta, cyan (the subtractive primary colors), and black liquid toners are employed. These toners present challenging design problems. One such problem area is in designing a system for delivery of such liquid toners from reservoirs to developer devices of the apparatus where toner is transferred to the photoconductor.

Typical color electrophotography liquid toner delivery subsystems employ separate pumps connected to refillable, or replaceable, toner reservoirs. Such pumping systems require either separate motors or complex gearing to drive the pumps. Each toner reservoir requires disconnect mechanisms and a vent system which can be relatively expensive components. Thus, liquid toner delivery subsystems are a complicated and relatively expensive component of the hard copy machine.

Two inherent problems with such subsystems include pump gear freeze-up and leakage of toner from seals. Dried toner residue may contaminate moving parts of a pump.

Additionally, upon replacement of the toner, the pumps will have some contamination from the previous batch. Therefore, to alleviate this contamination, the pumps must either be cleaned prior to a toner refill or, more expensively, replaced with a completely new toner cartridge. Because of the nature of the toner chemicals, any leakage is a potentially messy problem. Moreover, a toner reservoir vent must be open during operation and dripless during shipment even under changing atmospheric conditions. That is, the vent (along with the reservoir container and quick-disconnects) must pass air without leaking toner and be able to withstand up to approximately six pounds per square inch ("psi") pressure differential for extended periods of time without leakage.

Therefore, there is a need for a liquid electrophotography toner delivery system capable of cleanly delivering four different colors of liquid toner to respective developers. The system should operate in both a reliable and leak-free manner.

Furthermore, the system should provide a simple, clean, and inexpensive toner replacement mechanism. The system should utilize a toner reservoir cartridge that can be shipped commercially and thus be able to accommodate changes in atmospheric temperature and pressure.

SUMMARY OF THE INVENTION

In its basic aspect, the present invention provides an pneumatically-powered, liquid toner delivery system. A pump provides gas, such as air, under a predetermined pressure, to a toner reservoir. The reservoir is adapted to allow toner egress only when pressurized. A pressure regulator may be provided to control the pressurization. The toner delivery system is particularly adaptable to color printers and plotters having multiple reservoirs of toners, each having different pigmentation. Excess toner is recirculated through the system.

It is an advantage of the present invention that problems associated with leakage of toner are virtually eliminated.

It is an advantage of the present invention that only one pressurizing pump is required for machines having multiple toner reservoirs.

It is still another advantage of the present invention that the toner pump does not come into physical contact with toner chemicals.

Another advantage is that pneumatic pumps such as that employed in the present invention are inherently reliable.

Another advantage of the present invention is that it recirculates excess toner from a developer device station back to the toner reservoir from which it came.

It is an advantage of the present invention that it employs economical, commercially available, system components.

It is yet another advantage of the present invention to require fewer components than conventional systems.

It is another advantage of the present invention that it employs quickly and easily replaceable toner cartridges capable of withstanding changes in temperature and pressure as may be reasonably expected during commercial shipment.

Other objects, features and advantages of the present invention will become apparent upon consideration of the following detailed description and the accompanying drawings, in which like reference designations represent like features throughout the FIGURES.

The drawings referred to in this description should be understood as not being drawn to scale except if specifically noted.

DETAILED DESCRIPTION OF THE INVENTION

Reference is made now in detail to a specific embodiment of the present invention, which illustrates the best mode presently contemplated by the inventor(s) for practicing the invention. Alternative embodiments are also briefly described as applicable.

Figure 1:
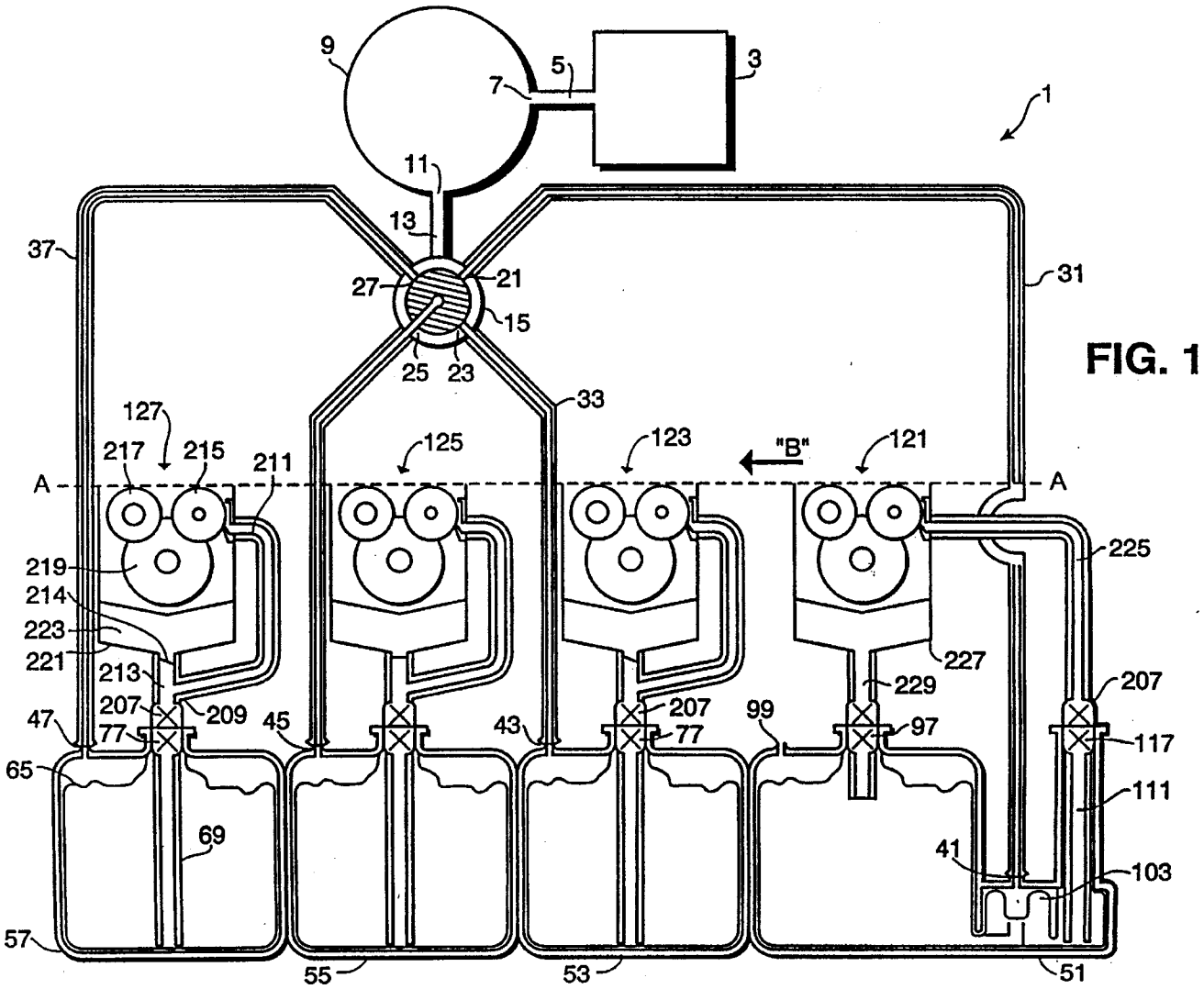
FIG. 1 is a schematic, plan view (side) drawing of the pneumatic toner delivery system of the present invention.

The pneumatic toner delivery system 1 of the present invention is depicted in FIG. 1. It has been found that a common diaphragm air pump 3, providing a range of one to five pounds per square inch ("PSI"), is sufficient to provide enough pressure to drive the system (although alternate pump mechanisms such as piston-type, vane-type, and centrifugal fan pumps will also work). Because only such a relatively low pressure is needed to power the system, simple rubber hoses and fittings may be utilized for all pneumatic connections.

The pump 3 is connected by a hose 5 to a gas inlet fitting 7 of an optional accumulator 9. By storing a predetermined volume, or "charge," of gas, use of an accumulator 9 can improve system timing and control. A gas outlet fitting 11 of the accumulator 9 is connected by a hose 13 to a valving or manifold mechanism for selectively distributing charges of gas to other components of the system 1.

As shown in FIG. 1, a charge of a gas, such as air, from the pump 3 (or the optional accumulator 9) can be directed to particular components of, for example, a color hard copy machine having multiple toner reservoirs, by use of a four-way rotary valve 15. A controllable manifold (not shown) may be substituted for such a valve but may add cost and control complexity to the system 1. Each outlet fitting 21, 23, 25, 27 (which because of the low pressure employed may be simple frictional interference fitments) of the rotary valve 15 is connected by a respective individual hose 31, 33, 35, 37 to a respective hose fitting 41, 43, 45, 47 of a respective individual toner cartridge 51, 53, 55, 57. The rotary valve 15 provides a device capable of selectively directing pneumatic pressure to a particular cartridge 51, 53, 55, 57.

Figure 2:
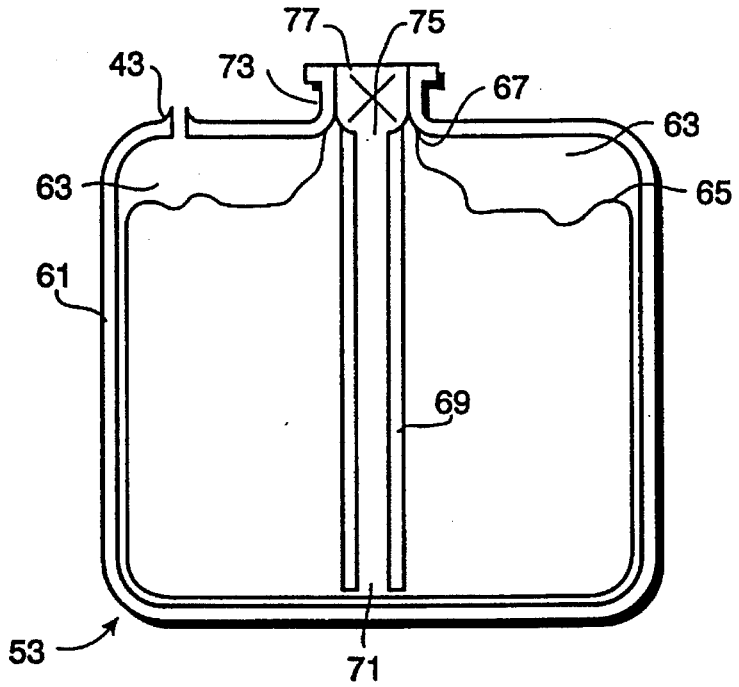
FIG. 2 is a schematic, plan view (side) drawing of a color toner cartridge adapted to be used in the toner delivery system of the present invention as shown in FIG. 1.

A toner cartridge for liquid chemical toner having a color pigment (such as yellow, magenta, or cyan, as are commonly used in the art for full color printing) is shown in FIG. 2. The cartridges 53, 55, 57 used for color toner in the system 1 are mechanically identical. While also useful for black toner, for considerations related to end user predilections, a special cartridge is described later in this specification.

The color toner cartridge 53 includes a relatively hard shell case 61, easily and economically fabricated from a material such as plastic. The relatively thin case 61 has an internal cavity 63. Within the cavity 63 is a collapsible bladder 65. The bladder 65 utilized to hold liquid toner is fabricated of a material that is selected to be generally impervious to the chemical liquid toner. The bladder 63 includes a spout opening 67.

The hard shell case 61 also includes an open-ended pipe 69. The pipe 69 extends inwardly into the bladder 65 via the spout opening 67 and has a distal end 71 open into the interior of the bladder 65 for receiving toner stored in the bladder 65. The case 61 also has a spout 73 into which the other end 75 of the bladder pipe 69 opens. The bladder spout opening 67 is sealed around the spout end 75 of the bladder pipe 69. It will be recognized from this construction of a color toner cartridge 53, 55, 57, that toner in a contained bladder 65 can only escape from the bladder 65 through the bladder pipe end 71, onward through the pipe 69 and the spout end 75 of the bladder pipe 69, and into the hard shell case spout 73. The hard shell case spout 73 also includes a dripless connector 77. Thus, no toner gets into the hard case cavity 63. No toner escapes from the bladder 65 through the case spout 73 until the dripless connector 77 is coupled to an compatible mating connector, for example, a male-female type connection.

Note that the hose fitting 43 of the toner cartridge 53 opens the cavity 63 to the atmosphere when the hose is disconnected. The hose fitting 43 thus serves as a vent to the cavity 63 during changes in atmospheric conditions that may occur during shipment of the toner cartridges. That is, the bladder 65 can expand and contract during reasonable changes of ambient temperature and pressure and there is no leakage of liquid toner from the cartridge 53.

Figure 3:
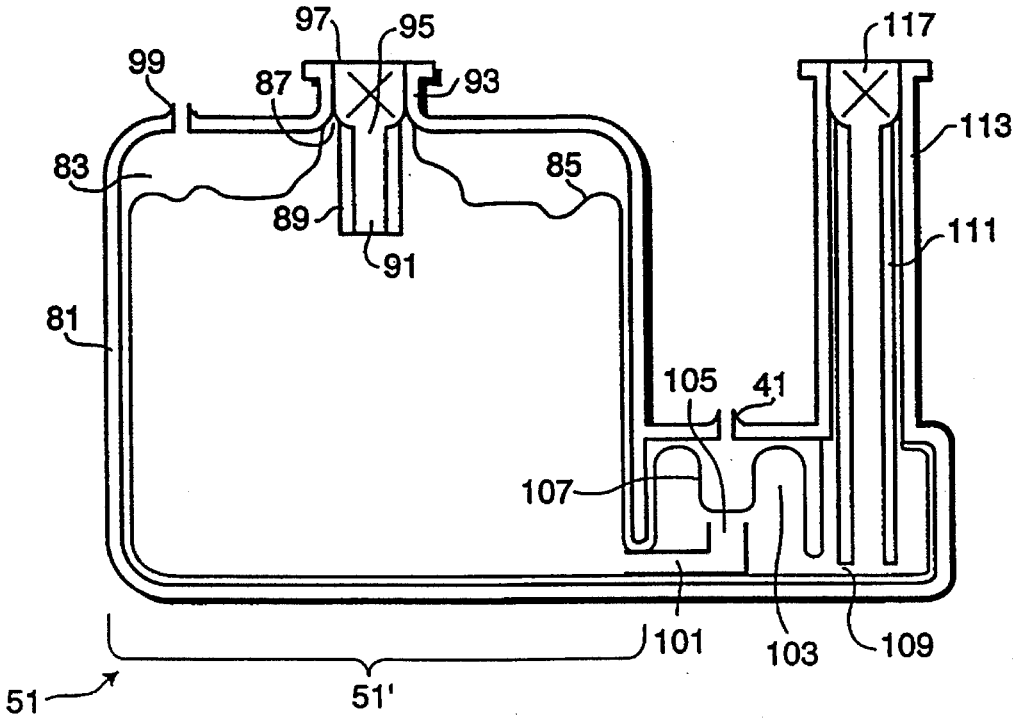
FIG. 3 is a schematic plan view (side) drawing of a black toner cartridge adapted to be used in the toner delivery system of the present invention as shown in FIG. 1.
Figure 4:
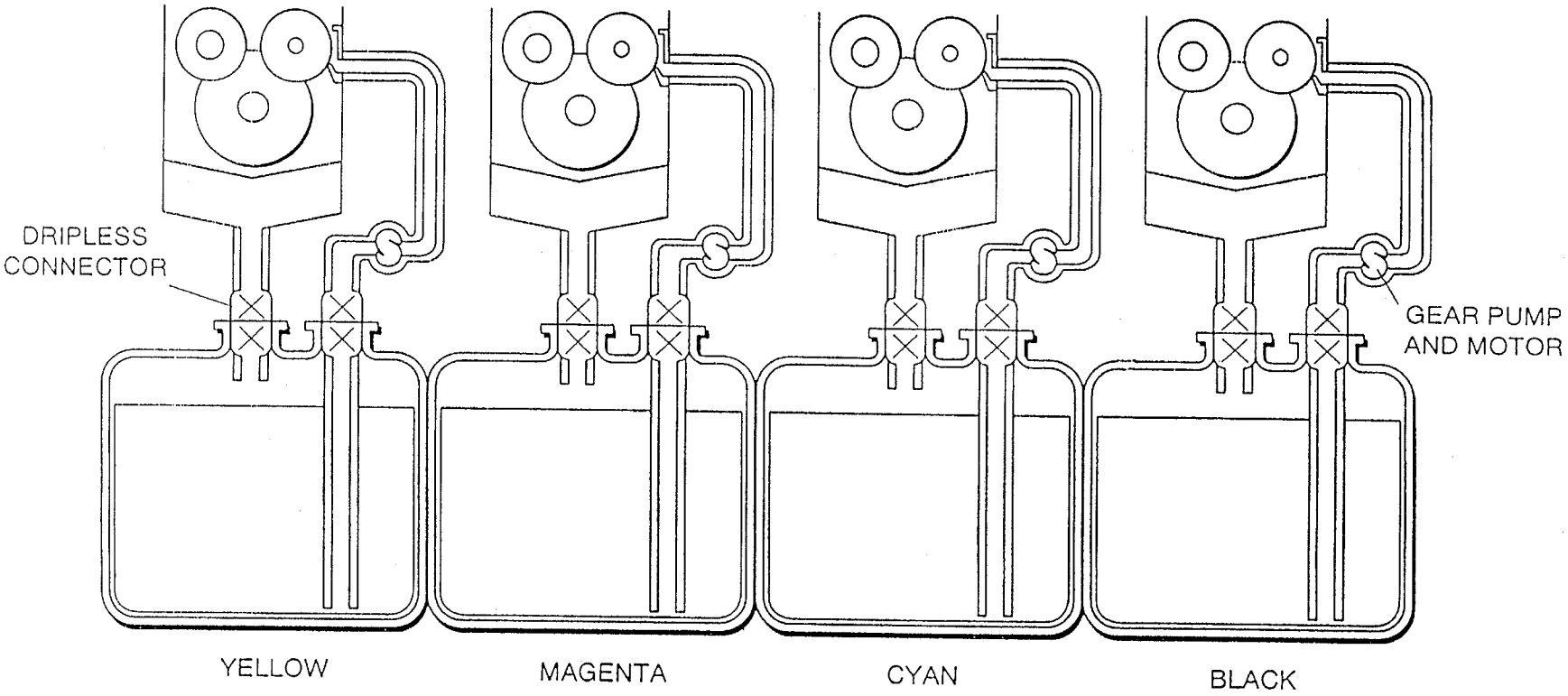
FIG. 4 is a toner delivery system.

As mentioned, while the toner cartridge 53 of FIG. 2 can be used for black toner, it is well-known that in print and image reproduction, black print is more common than color. For example, with a color laser printer, the user is likely to print many pages of simple text for each single page where color is used. Therefore, it is advantageous to provide a system where a "CONTINUOUS BLACK MODE" of operation can be selected. Therefore, an optional black toner cartridge 51 having a different configuration than the color toner cartridges 53, 55, 57 is shown in FIG. 3. However, the black toner cartridge 51 requires no extraordinary adaptations to use the same pressurizing scheme as described above.

The black toner cartridge 51 has a main bladder cartridge portion 51' that is analogous to the color toner cartridge 53 just described. A hard shell case 81 provides a cavity 83 for housing a bladder 85 having a spout opening 87 that is sealingly fixed about a bladder pipe 89 at a case spout 93. Open ends 91, 95 of the bladder pipe 89 provide fluid communication between the interior of the bladder 85 and the case spout 93 having a first dripless connector 97. A vent 99 opens the case cavity 83 to the ambient atmosphere.

Added to the configuration of the black toner cartridge 51 is a toner reservoir outlet pipe 101 that is positioned generally such that black toner is continuously supplied to a separate pump chamber 103 of a case 81 portion surrounding an open end 105 of the pipe 101. The pipe 101 extends into the pump chamber 103, allowing toner to fill the chamber 103. The toner outlet pipe 101 can be positioned so that the weight alone of the toner under ambient atmospheric pressure via vent 99 into the cavity 83 and on the bladder 85 supplies toner to the pump chamber 103.

In this black toner cartridge 51, it is the pump chamber 103 that has an air hose fitting 41 connection to the rotary valve 15. A sealed, pneumatic flex diaphragm 107 extends from the air hose fitting 41 into the pump chamber 103. The flex diaphragm 107 is designed such that under pressure applied via the air hose 31, the bladder outlet pipe 101 is momentarily sealed by the flex diaphragm 107 and toner in the pump chamber 103 is forced through a pump chamber outlet 109. The pump chamber outlet 109 in turn feeds a bladder pipe 111 in an elongated spout 113 portion of the hard shell case 81. The elongated spout 113 and bladder pipe 111 serve substantially the same function as the bladder pipes of the color toner cartridges as described with respect to FIG. 2. The elongated spout 113 of the hard shell case 81 also includes a second dripless connector 117 for toner egress to a developer device.

The toner cartridges 51, 53, 55, 57 can be fabricated to be disposable or refillable.

Returning now to FIG. 1, it can be seen that each cartridge 51, 53, 55, 57 is connected at its respective to a respective developer subsystem 121,123, 125, 127 of the system 1. The pneumatic toner delivery system 1 of the present invention is adaptable to known forms of electrophotographic developer subsystems. For example, patent application U.S. Ser. No. 08/248,614, and continuing at U.S. Ser. No. 08/269,310, filed on even date herewith, by Jeran et al., discloses a developer system in which a pneumatically driven platen brings the latent image on a photoconductor into functional proximity with the developer subsystem in a manner suited to the present invention. In the main, for the purpose of disclosure of the present invention, an exposed photoconductor brought into proximity with the shown developer subsystem is represented by phantom line A—A, moving in the direction indicated by arrow "B." Each developer subsystem 121, 123, 125, 127 operates in the substantially the same manner. After exposure to a light pattern, the photoconductor, being transported along line A—A in the direction of arrow "B," makes first contact with a developer roller 215 where toner is applied to the latent image. The photoconductor continues onward in the direction of arrow "B" into contact with a second roller 217, known as a "squeegee," which removes excess liquid from the toned image prior to transfer to the hard copy medium. Excess liquid 223 from the squeegee roller 217 is deposited in a drip pan 221 by a scrub roller 219 used to clean the other two rollers.

With respect to the color cartridges 53, 55, 57, dual path conduit 209 provides a fluid connection between a cartridge 53, 55, 57 and its respective developer subsystem 123, 125, 127. The "Yellow" toner subsystem of the system 1 will be used as an example.

The yellow toner cartridge 57 has two connectors, the cartridge hose fitting 47 and the dripless connector 77. The hose fitting 47 is connected to air pump 3 via the rotary valve 15 by hose 37. The connector 77 of the cartridge 53 is adapted to be connected to a mating dripless connector 207. A liquid tight fitting is appropriate. Thus, the dripless connector 77 is mated to a dual path tubing 209 by mating connector 207. As pneumatic pressure is applied to the bladder 63 from the pump 3, toner is forced through the bladder pipe 69, the dripless connectors 77, 207, and on through into the dual path tubing 209. One path tube 211 delivers the toner from the bladder 63 to a developer subsystem developer roller 215. The second path tube 213 includes a one-way flapper valve 214 which permits flow of toner liquid 223, namely the excess toner removed from the photoconductor by the squeegee roller 217 and scrub roller 219. That is, toner from the developer subsystem drip pan 221 flows back through flapper valve 217, back into the second path tube 213, through the dripless connectors 77, 207, and back into the bladder 63 only when pneumatic pressure from the pump 3 is removed from the bladder 63.

Appropriate control devices sequence the developer cycles of the photoconductor with respect to each of the other color cartridges 53, 55 as required to develop the latent image fully.

While black liquid toner from cartridge 51 is adapted to be provided to a mixed print and color image in substantially the same manner as the color liquid toner, as mentioned previously, a CONTINUOUS BLACK MODE is desirable, for example, for printing consecutive pages of continuous text. Thus, the rotary valve 15 may be positioned to provide pneumatic pressure from the pump 3 through the hose 31 to the pump chamber 103 (FIG. 3). The pump chamber 103 is pressurized when the flexible diaphragm 107 is forced downward and seals off the inlet tube 101 at end 105, forcing toner out through the bladder pipe 111. Upon removal of pneumatic pressure, the diaphragm 107 returns to its relaxed position, opening the inlet tube 101 and allowing another charge of toner to enter the pump chamber 103. Thus, black liquid toner is supplied from the single path connector tube 225 to the developer subsystem 121. Because of this altered black cartridge 51 configuration, continuous flow of black liquid toner eliminates the need for a flapper valve between the black developer subsystem drip pan 227 and a toner return tube 229 connected to the first dripless connector 97.

The present invention provides a toner delivery system 1 using inexpensive parts of simple pneumatic functionality. Thus, the reliability of the entire system is improved. In operation, the diaphragm pump 3 is selectively connected via the controllable rotary valve 15 to the cartridge from which toner is to be applied to develop the latent image on the photoconductor as it is transported passed a particular developer device 121, 123, 125, 127. Pressure on the bladder (or in the optional black cartridge 51, pressure to the pump chamber 103) forces toner from a cartridge to the developer roller 215. Excess toner is returned directly into the bladder for immediate reuse.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents.

What is claimed is:

1. A toner delivery system for a hard copy apparatus, said system comprising:

a plurality of media developer devices;

pressurizing means for providing pressurized gas under a predetermined pressure;

at least one toner containing means for each of said media developer devices for providing reservoirs of toner, each of said containing means having an inlet means connected to said pressurizing means for receiving said pressurized gas, and a toner outlet means for releasing liquid toner from said containing means to said developer device a compressible, liquid toner reservoir, a cartridge means for containing said liquid toner reservoir in an inner cavity formed by said cartridge means, wherein said inlet means further comprises a vent opening said cavity to the atmosphere and adapted to connect to said pressurizing means and said outlet means further comprises at least one dripless connector for connecting said reservoir to said developer device in fluid communication such connected to said developer device; and a single regulating means, connected to said inlet means, for controlling the flow of toner from said containing means to said developer device.

2. The system as set forth in claim 1, wherein said single regulating means further comprises:

valving means, connected between said pressurizing means and said inlet means, for controlling gas flow from said pressurizing means to said inlet means.

3. The system as set forth in claim 2, wherein said valving means further comprises:

a single rotary valve adapted to provide gas pressure selectively to each of said containing means.

4. The system as set forth in claim 2, wherein said valving means further comprises:

a manifold, having one valve for each said toner containing means, such that gas pressure from said pressurizing means can be selectively provided to said containing means.

5. The system as set forth in claim 1, wherein said outlet means further comprises:

a dripless mating connector for coupling to said at least one mating connector;

a conduit, connected at a proximal end to said dripless mating connector and at a distal end to said developer device, whereby a liquid-tight connection is established between said reservoir and said developer device.

6. The system as set forth in claim 5, wherein said system further comprises:

a liquid toner returning means, connected between said developer device and said conduit, for receiving excess liquid toner from said developer device.

7. The system as set forth in claim 6, wherein said returning means further comprises:

a valve means for releasing liquid toner from said returning means into said reservoir when no gas pressure is being applied to said inlet means.

8. The system as set forth in claim 1, further comprising:

each of said toner containing means containing a toner of different color.

9. The system as set forth in claim 8, wherein one of said containing means contains black toner.

10. The system as set forth in claim 9, wherein said containing means for black toner further comprises:

a compressible toner reservoir, having an outlet pipe;

a cartridge means for containing said toner reservoir in a cavity of said cartridge means, said cartridge means further having a vent open to the atmosphere and closed to said reservoir contained within said cavity;

said inlet means further comprises a fitting adapted to connect to said pressurizing means;

a flex diaphragm mounted within said cartridge means between said inlet means and said outlet pipe such that said pressurizing means flexes said diaphragm to close said outlet pipe while pumping toner to said outlet means; and said outlet means further comprises at least one dripless connector for connecting said reservoir to said developer device in fluid communication, whereby toner egress from said reservoir is prevented until said outlet means is connected to said developer device and said flex diaphragm is pressurized by said pressurizing means.

11. A pneumatic toner delivery apparatus for a color printing and plotting apparatus, having an electrostatic latent image developer station, comprising:

a pneumatic pump;

flow controlling means, connected to said pump, for controlling pneumatic pressure from said pump;

four toner cartridges, each having a central cavity, and each having:

a collapsible reservoir means, within said cavity, for containing toner therein, a fitting for connecting said cavity to said flow controlling means for receiving and releasing pneumatic pressure created by said pump within said cavity, a dripless spout connector, connected to said collapsible reservoir means within said cavity, for allowing ingress and egress of toner from said collapsible reservoir means and said cartridge; and conduit means, connected to said dripless spout connector, for delivering toner from said collapsible reservoir means under pneumatic pressure from said pump through said conduit means to said developer station and returning toner from said developer station when said pneumatic pressure is removed.

12. The apparatus as set forth in claim 11, wherein said cartridges further comprise:

each said collapsible reservoir means containing a liquid toner of different color and one said collapsible reservoir means containing black toner.

13. The apparatus as set forth in claim 12, wherein said cartridge containing the collapsible reservoir means with black toner further comprises:

a vent opening said cavity to ambient atmospheric conditions;

a reservoir outlet pipe, connected to release toner under its own weight;

a flex diaphragm, mounted between said fitting and said outlet pipe such that under pressure from said pump said diaphragm closes said reservoir outlet pipe and pressurizes toner within a portion of said cartridge around said outlet pipe.

14. The apparatus as set forth in claim 13, wherein said conduit means further comprises:

a first tube connecting said portion of said cartridge around said outlet pipe to said dripless spout connector, and a second tube connecting said reservoir to said developer station for receiving excess toner from said developer station.

15. The apparatus as set forth in claim 11, wherein said flow controlling means further comprises:

a rotary valve adapted to provide a charge of gas under pressure to a selected cartridge.

16. The apparatus as set forth in claim 15, wherein said flow controlling means further comprises:

an accumulator, connected between said pump and said rotary valve, for storing a predetermined charge of gas.

* * * * *